United States Patent [19]

Adrian et al.

[11] 4,389,019

[45] Jun. 21, 1983

[54] METHOD OF AND APPARATUS FOR THE DRY SEPARATION OF PYRITE FROM COAL

[75] Inventors: Fritz Adrian, Ratingen; Heinrich Sättler, Treis; Werner Sauerland, Voerde, all of Fed. Rep. of Germany

[73] Assignee: Steag Aktiengesellschaft, Essen, Fed. Rep. of Germany

[21] Appl. No.: 200,379

[22] Filed: Oct. 24, 1980

[30] Foreign Application Priority Data

Oct. 27, 1979 [DE] Fed. Rep. of Germany ..... 2943556

[51] Int. Cl.[3] ..... B02C 21/00

[52] U.S. Cl. ..... 241/19; 241/24; 241/97

[58] Field of Search ..... 241/24, 18, 60, 25, 241/152, 19, 80, 79.1, 76, 77, 97; 110/342, 280, 213, 224, 232; 122/4 D

[56] References Cited

U.S. PATENT DOCUMENTS

| | | | |
|---|---|---|---|
| 3,923,256 | 12/1975 | Dörner | 241/76 |
| 3,982,699 | 9/1976 | Jäger | 241/14 |
| 4,059,060 | 11/1977 | Gambs | 110/232 |

*Primary Examiner*—Mark Rosenbaum
*Assistant Examiner*—Timothy V. Eley
*Attorney, Agent, or Firm*—Karl F. Ross; Herbert Dubno

[57] ABSTRACT

A dry method of removing pyrite from mineral coal in which the coal is mill-dried in a milling gas stream and the milled product is subjected to classification to recover a predominantly coal combustible fine fraction and a gravel or coarse fraction containing mining detritus, pyrite and coal. The gravel or coarse fraction, according to the invention, is subjected to density separation in whole or in part before being recycled to the milling stage and the density separation separates a light coal fraction from a heavy fraction containing the pyrite and detritus. This coal fraction can be returned to the miling stage while the heavy fraction can be subjected to further separation to recover the pyrite for other use or treatment.

5 Claims, 1 Drawing Figure

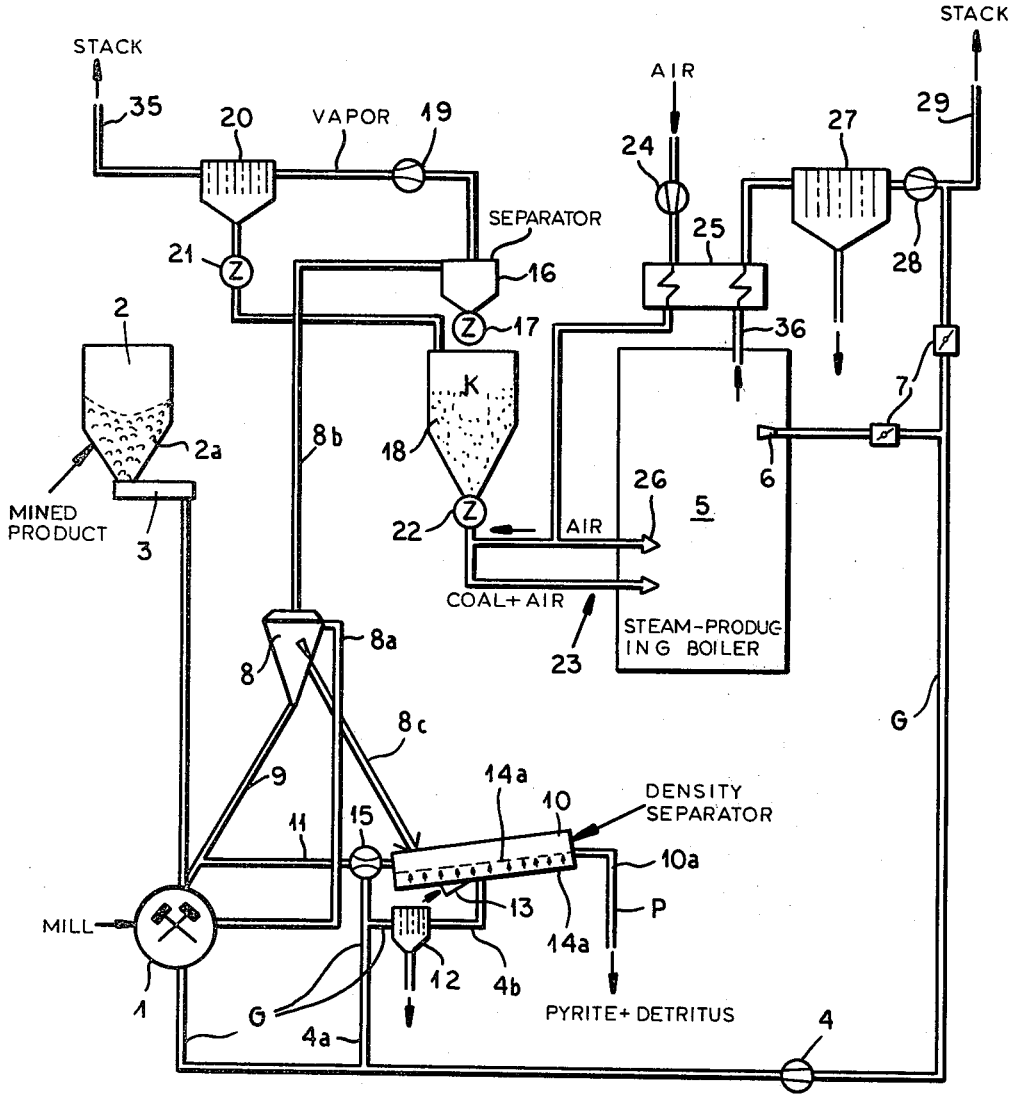
STACK
STACK
AIR
35
20
VAPOR
19
24
27
29
SEPARATOR
25
21
16
28
2
17
36
K
7
2a
8b
18
6
26
5
MINED PRODUCT
3
22
AIR
COAL+AIR
STEAM-PRODUCING BOILER
23
8a
8
G
8c
9
14a
10
DENSITY SEPARATOR
11
15
10a
13
P
MILL
14a
12
4b
1
G
PYRITE+DETRITUS
4a
4

METHOD OF AND APPARATUS FOR THE DRY SEPARATION OF PYRITE FROM COAL

CROSS-REFERENCE TO RELATED APPLICATION

This application is related to our concurrently filed, commonly assigned, copending application Ser. No. 200,380.

FIELD OF THE INVENTION

Our present invention relates to a method of and to an apparatus for the dry separation of pyrite from mineral coal and, more particularly, to a method of and an apparatus for removing noncombustible or combustion-impeding components including pyrites, from mineral or hard coal.

BACKGROUND OF THE INVENTION

Mineral coal, frequently referred to also as hard coal, pit coal or Steinkohle, is extracted from the mining shafts and tunnels generally accomplished by noncombustible or combustion-impeding impurities including pyrites and other mineral matter referred to hereinafter as mining detritus.

Various method have been proposed to separate these impurities from the coal, especially since pyrites contribute a large portion of the sulfur found in the mined product.

The pyrites are generally in the form of iron disulfides (iron pyrite) and contain up to 50% and more by weight of sulfur. In such coal mined in the Ruhr valley, for example, some 40 to 60% of the sulfur content is in the form of pyrites .

The pyrite crystals, generally in pure form, are locked into the coal structure together with other mineral matter or, conversely, the coal may be interlaced in the structure of other mineral matter containing such pyrites.

Removal of the pyrites from such mineral coal is important prior to combustion to reduce the sulfur content of the combustion gases and hence the environmental contamination thereby.

In the methods proposed heretofore for the removal of pyrites from coal, use has been proposed of the magnetic characteristics of the pyrite. The mined product is subjected to magnetic fields which separate the pyrite from the coal. Such systems require expensive apparatus and are energy intensive. In fact, these methods are still under investigation and have not been applied on a large scale in a continuous manner successfully hitherto.

Another disadvantage of the magnetic separation approach is that it does not remove mineral detritus other than pyrites from the coal.

The methods which have been successfully applied heretofore on a large scale are wet methods utilizing hydrocylones, flotation processes and the like which have a further advantage in that they allow classification of the coal for its various marketing possibilities.

While these methods have been improved upon in recent years and have played a significant role in the reduction of the sulfur content in the combustion of coal, they are not universally applicable and involve certain disadvantages including that of recovering the coal in a wet state and difficulties in handling the wet product.

OBJECTS OF THE INVENTION

It is the principal object of the present invention to provide a method of separating pyrite from coal which overcomes the disadvantages of the aforementioned earlier systems and which is economical, continuous and efficient.

Another object of the invention is to provide a dry method of separating pyrite and mining detritus from coal which is simpler and less expensive than earlier techniques.

It is also an object of the invention to provide an apparatus or plant for the dry separation of pyrites from coal.

SUMMARY OF THE INVENTION

These objects and others which will become apparent hereinafter are attained, in accordance with the present invention, in a dry method for removing pyrites from the mined coal product which contains pyrite, mineral coal of the character described and mining detritus, which comprises initially mill-drying the mined product in a milling stage, advantageously with a hammer mill, in a milling gas stream, subjecting the milled product to classification in a sizing stage to separate combustible fines (predominantly coal) from a gravel product (coarse fraction) containing the pyrite, mineral detritus and coal, and passing the gravel product along a recycling path back to the milling stage.

According to the invention, along the recycling path, the recycled gravel product in whole or in part (depending upon the pyrite content) is subjected to a density separation stage to separate a heavy component predominantly of the heavy pyrite but also containing the mineral detritus from a light component predominantly consisting of coal, this matter component being recycled to the milling stage or being subjected to other applications.

The density separation stage of the present invention operates in a dry manner to separate components by specific gravity or density and utilize the fact that the density of pyrite is approximately 5 g/cm$^3$, that of the mineral detritus is about 2 to 2.5 g/cm$^3$ and that of the coal is about 1.2 to 1.7 g/cm$^3$, depending upon its composition.

The pyrite crystals are hard and are milled only with difficulty so that they are predominantly contained in the gravel product which is outputted by the milling stage. As a consequence with the system of the present invention, we can be certain that at least most of the pyrite will be found in the gravel product or coarse product of the milling stage and can be separated from any coal in this coarse product by the density separation stage.

Because of the different millabilities of the components of the mined product, the gravel or coarse product recycle provides a progressive enrichment in the more difficult-to-mill material, namely, the pyrite and mineral detritus. Any interstratified coal is released by the milling operation and can be separated from the pyrite in the density separation stage.

It may be noted that the gravel product or recycle is also enriched (by comparison with the original mined product) in quartz-containing rock which likewise is difficult to mill.

According to the invention, recycling of the gravel product is continued without interception until the pyrite content reaches a level which makes it economical to separate the pyrite component from any entrained coal in the density separation stage. When the pyrite content of the recycle is very high, recycling can be interrupted and all of the gravel product subjected to the density separation.

According to another feature of the invention, the gravel product of the recycle, prior to introducing into the density separation stage is subjected to a sifting whereby a large particle size fraction (coarsely milled coal) is removed.

The mixture of pyrite and comminuted mineral detritus can be subjected to a further sifting following the density separation stage to recover the pyrite, for example, in an economical manner, e.g. for extraction of sulfur from the pyrite by conventional processes. This latter sifting step is also advantageous in that traces of coal can be removed since with respect to these traces the pyrite and mineral detritus is comparatively coarse grained.

The system of the present invention has numerous advantages. For example, the dry separation of the pyrite can be carried out conveniently in conjunction with a conventional system for milling and classifying the mineral product without special additional costs utilizing the fact that the milling stage creates the condition for separation of the pyrite. It is thus possible with minimal additional cost or energy consumption to reduce sulfur emissions of coal subject to milling and drying.

Because hard pyrites are removed from the milling recycle, there is also a noticeable reduction in the wear of the mill.

The system of the invention can be utilized in conjunction with a mineral coal power plant with great economic advantages since the removal of pyrites from the coal permits sulfur-rich coal to be supplied to the plant and reduction in the equipment and cost for desulfurizing exhaust gases.

The invention even permits pyrite-rich coal-mining burdens and other coal-containing mineral matters which have been considered wastes heretofore to be economically used.

The method of the invention can be carried out with relatively simple and inexpensive apparatus since one need only add a density separation stage to the gravel product recycle path in or downstream of the classifier.

While various separation devices may be used, in the preferred and best mode embodiment of the invention, the separator is an inclined vibrating trough which can be provided with fluidization means so that the solids are entrained by gases emerging through the perforate floor of the trough. In this separator, the less dense component, i.e. the entrained coal, passes downwardly while the heavier product, i.e. mixture of pyrite and mineral detritus moves upwardly.

Such vibrating troughs have also been termed aerated vibrating troughs and are formed with a floor above a plenum to which the fluidizing gas is supplied. The fluidizing gas is usually air although an exhaust gas can be used as well.

The rate and velocity with which the gas is supplied is such that the solids in the trough are only partially fluidized. The heavier components thus are not fluidized and are mechanically entrained by the vibrating movement of the trough against their gravitational component and lifted to the upper portion thereof. The latter component is fluidized and generally migrates down the trough.

This latter component is returned to the milling stage.

The mixture of mineral detritus and pyrite which is recovered from the upper outlet of the trough contains only a small proportion of coal.

The sulfur of the pyrite can be converted into sulfuric acid, for example.

The outlet of the trough can be connected, if desired, to a fluidized bed combustor in which the sulfur is converted to sulfur oxides which may be absorbed or transformed to sulfur trioxides by the contact catalyst process before being absorbed in sulfuric acid. Alternatively, a sulfur oxide absorbent may be introduced into the fluidized bed combustor (see the aforementioned copending application).

BRIEF DESCRIPTION OF THE DRAWING

The above and other objects, features and advantages of the present invention will become more readily apparent from the following description, reference being made to the accompanying drawing the sole FIGURE of which is a flow diagram illustrating the principles of the invention.

SPECIFIC DESCRIPTION

In the flow diagram of the drawing we have shown a milling apparatus 1 which can be in the form of a hammer mill and which is supplied with the crude mined coal product 2*a* from a hopper 2 via a metering worm device represented at 3. The mined product is subjected to milling in a dry gas stream which is supplied by a blower 4 drawing exhaust gas G from a steam-producing boiler 5 via an outlet 6 thereof. Flap-type valves 7 control the distribution of the exhaust gas to the mill and elsewhere and serve to regulate the temperature thereof in accordance with the requirements of the mill-drying process.

The comminuted milled product, entrained in the milling gas is carried into a classifier 8 via a line 8*a*, the classifier being of the cyclone type.

The fines, i.e. finely ground coal K, are entrained via line 8*b*, while the coarse product (gravel product) containing the pyrite crystals P and mineral detritus as well as large coal particles, separated from the fines, is recycled via line 9 to the mill 1.

This coarse product can be tapped from the recycling path 8*a*, 8, 9 via line 8*c* and is delivered to a density separator 10 in which it is separated, in turn, from the coal which is returned to the mill via line 11.

The mixture of heavy pyrite and mineral detritus is discharged from the upper outlet via line 10*a*. The density separator 10 is in the form of an inclined vibrating trough having a perforated or sieve bottom 14 above a plenum 14*a* to which a fluidizing gas is supplied.

In the embodiment shown, the fluidizing gas is the gas G delivered by the blower 4 and fed via line 4*a* and a particle-removing filter 12 to the line 4*b* opening into the plenum 14*a*.

The vibrator for the trough is represented at 13. The vibrator and the fluidizing gas supply are arranged so that the heavy component resting upon the floor 14 travels upwardly to the outlet 10*a* while the latter product is fluidized and passes downwardly to be drawn via the Venturi or injector device 15 into line 11 and the mill.

The heavy component can be collected or subjected to combustion to other treatment. Preferably, it is subjected to combustion in the manner described in the aforementioned copending application.

The finely milled coal with a consistency of dust, and vapors are separated at 16 with the coal being metered via a gate 17 into the hopper 18. This coal can then be delivered via a gate and metering outlet 22 for distribution to the burner 23 of boiler 5.

The gas withdrawn from the separator 16 passes via a vapor blower and a filter 20 to the stack or chimney 35. Any collected dust, i.e. coal is returned via the gate feeder 21 to the hopper 18.

The combustion air delivered by blower 24 is preheated at 25 and fed by a secondary air nozzle 26 to the combustion chamber of the boiler 5, a portion of this air fluidizing and entraining the coal fed at 22 to the burner 23.

Exhaust gas which is not withdrawn at 6, is recovered at 36 and passes through the air preheater 25 in indirect heat exchange with the fresh air. This exhaust gas is subjected to filtering at 27 and is discharged via the suction blower 28 to the stack 29 into the atmospere.

We claim:

1. A dry method of separating pyrite from mineral coal comprising the steps of:

(a) milling and drying in a gas stream mined mineral coal product containing coal, pyrite and mineral detritus to produce a fine component consisting predominantly of coal and a gravel component comprising pyrite, mineral detritus and coal;

(b) classifying the milled product of step (a) to separate said components from each other and recycling a portion of said gravel component to step (a); and (c) withdrawing simultaneously the remainder of the gravel component from step (b) and subjecting same to a density separation to produce a light product consisting predominantly of coal and a heavy product consisting predominantly of pyrite and mineral detritus whereby the pyrite is separated from the coal.

2. The method defined in claim 1 wherein said light product is supplied to step (a) for further milling.

3. The method defined in claim 1 or claim 2 further comprising the step of sifting said gravel component to remove large-particle coal therefrom prior to subjecting said gravel component to density separation.

4. The method defined in claim 1 or claim 2, further comprising the step of subjecting said heavy product to sifting subsequent to said density separation.

5. A dry method of separating pyrite from mineral coal comprising the steps of:

(a) milling and drying in a gas stream mined mineral coal product containing coal, pyrite and mineral detritus to produce a fine component consisting predominantly of coal and a gravel component comprising pyrite, mineral detritus and coal;

(b) classifying the milled product of step (a) to separate said components from each other and recycling a portion of said gravel component to step (a);

(c) withdrawing simultaneously the remainder of the gravel component from step (b); and (d) subjecting the withdrawn remainder of the gravel component to a density separation by oscillating same while passing a gas through the oscillating material, thereby fluidizing coal contained in said remainder of the gravel component and separating it from the pyrite and mineral detritus.

* * * * *